US011507018B2

(12) United States Patent
Ogawa

(10) Patent No.: US 11,507,018 B2
(45) Date of Patent: Nov. 22, 2022

(54) IMAGE FORMATION AIR BLOWING DEVICE FOR BLOWING AIRFLOW TOWARD A TARGET SPACE ON A DISCHARGE TABLE

(71) Applicant: KYOCERA Document Solutions Inc., Osaka (JP)

(72) Inventor: Shikitaro Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/374,833

(22) Filed: Jul. 13, 2021

(65) Prior Publication Data

US 2022/0019175 A1 Jan. 20, 2022

(30) Foreign Application Priority Data

Jul. 16, 2020 (JP) ..... JP2020-122453

(51) Int. Cl.

| | |
|---|---|
| ***G03G 21/00*** | (2006.01) |
| ***B65H 29/00*** | (2006.01) |
| ***G03G 21/20*** | (2006.01) |
| ***G03G 15/00*** | (2006.01) |
| ***B65H 29/24*** | (2006.01) |

(52) U.S. Cl.

CPC ..... *G03G 21/206* (2013.01); *B65H 29/246* (2013.01); *G03G 15/6552* (2013.01); *G03G 2215/00421* (2013.01); *G03G 2221/1645* (2013.01)

(58) Field of Classification Search

CPC ..... G03G 15/6552; G03G 15/6573; G03G 21/206; G03G 2215/00421; G03G 2221/1645; B65H 29/245; B65H 29/246

USPC ..... 399/92, 405

See application file for complete search history.

(56) References Cited

U.S. PATENT DOCUMENTS

| | | | | |
|---|---|---|---|---|
| 2007/0116489 | A1* | 5/2007 | Kim | G03G 21/206 399/92 |
| 2013/0294805 | A1* | 11/2013 | Nawa | G03G 15/6552 399/405 |
| 2014/0062005 | A1* | 3/2014 | Suzuki | B65H 31/38 271/220 |
| 2014/0145395 | A1* | 5/2014 | Takano | G03G 15/6552 271/211 |
| 2016/0185552 | A1* | 6/2016 | Hoshino | G03G 15/6552 271/211 |
| 2019/0382227 | A1* | 12/2019 | Sakagami | G03G 15/6552 |

FOREIGN PATENT DOCUMENTS

JP H11167232 A 6/1999

* cited by examiner

*Primary Examiner* — Robert B Beatty
(74) *Attorney, Agent, or Firm* — Alleman Hall Creasman & Tuttle LLP

(57) ABSTRACT

An image formation air blowing device includes an outlet and an airflow control portion. The outlet blows out an airflow toward a target space on a discharge table to which a sheet with an image formed thereon by an image forming portion is discharged. The airflow control portion controls a direction of the airflow at least in a horizontal plane in the target space.

8 Claims, 8 Drawing Sheets

IMAGE FORMATION AIR BLOWING DEVICE FOR BLOWING AIRFLOW TOWARD A TARGET SPACE ON A DISCHARGE TABLE

INCORPORATION BY REFERENCE

This application is based upon and claims the benefit of priority from the corresponding Japanese Patent Application No. 2020-122453 filed on Jul. 16, 2020, the entire contents of which are incorporated herein by reference.

BACKGROUND

The present disclosure relates to an image formation air blowing device and an image forming apparatus.

There is known, as a related technology, an image forming apparatus that includes a blowing device (a fan unit) that is a cooling means for cooling a sheet with an image formed thereon (a transferred sheet) discharged on a discharge table (a sheet discharge tray). In the image forming apparatus according to the related technology, the blowing device is disposed in the vicinity of an outlet (a sheet discharge portion) from which the sheet is discharged, and below the sheet discharged from the outlet such that the blowing device blows cool wind toward a lower surface of the sheet on which the image has been formed. The blowing device takes in an external air and cool the lower surface of the sheet by blowing the external air to the lower surface of the sheet.

SUMMARY

An image formation air blowing device according to an aspect of the present disclosure includes an outlet and an airflow control portion. The outlet blows out an airflow toward a target space on a discharge table to which a sheet with an image formed thereon by an image forming portion is discharged. The airflow control portion controls a direction of the airflow at least in a horizontal plane in the target space.

An image forming apparatus according to another aspect of the present disclosure includes the image formation air blowing device and an apparatus main body. The apparatus main body includes the image forming portion, and the image formation air blowing device is mounted in the apparatus main body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Embodiment 1

[1] Entire Configuration of Image Forming Apparatus

First, an entire configuration of an image forming apparatus 10 according to the present embodiment is described with reference to FIG. 1 and FIG. 2.

Figure 1:
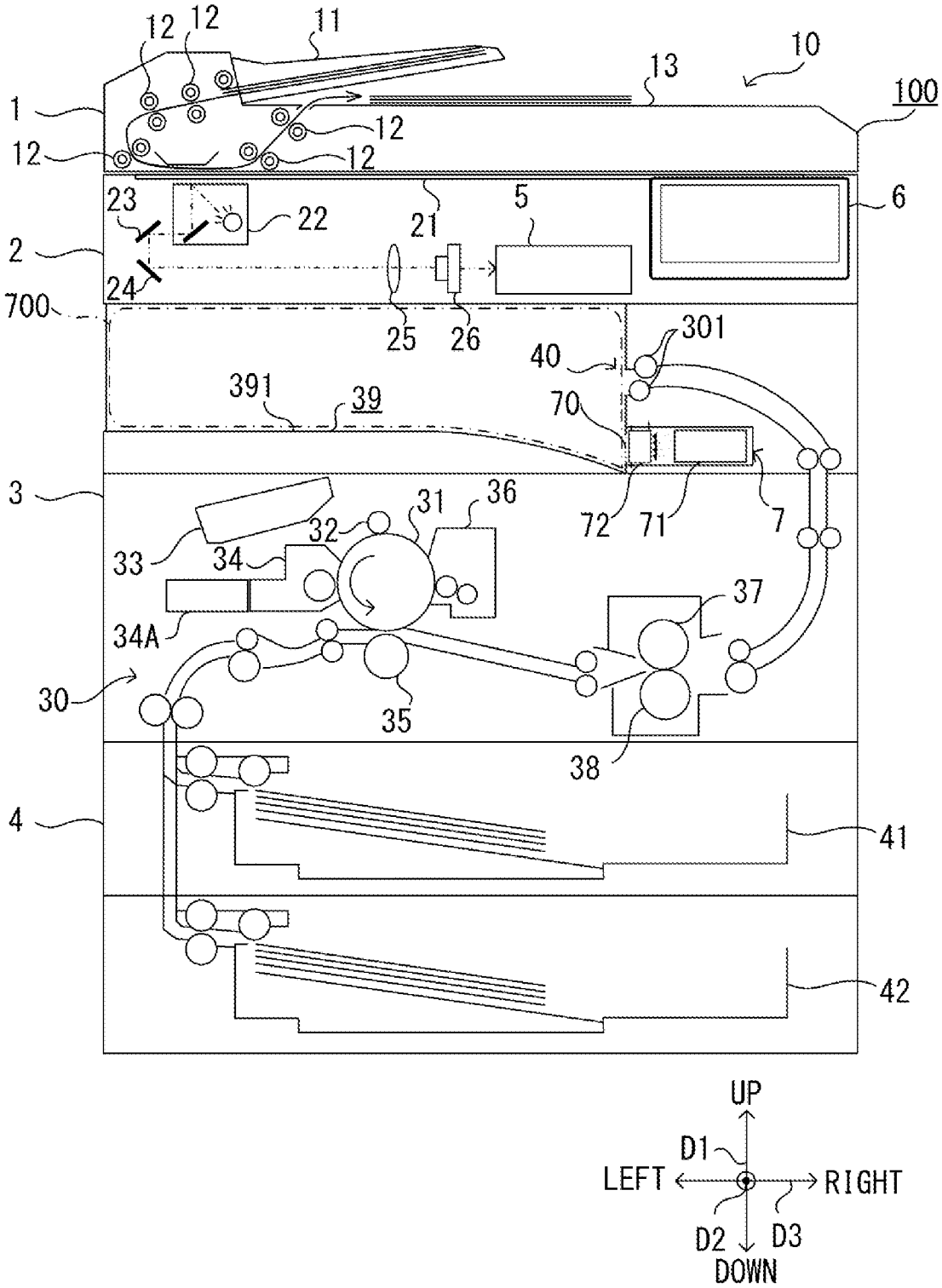
FIG. 1 is a schematic diagram showing a configuration of an image forming apparatus according to Embodiment 1.

For the sake of explanation, an up-down direction D1 is defined as a vertical direction in a state where the image forming apparatus 10 is installed usably (the state shown in FIG. 1). In addition, a front-back direction D2 is defined as a direction of the image forming apparatus 10 shown in FIG. 1 perpendicular to the paper surface of FIG. 1, wherein the front side of FIG. 1 is defined as the front. Furthermore, a left-right direction D3 is defined on the supposition that the left-side of the paper surface of FIG. 1 is the left.

The image forming apparatus 10 according to the present embodiment is, for example, a multifunction peripheral having a plurality of functions such as a scan function for reading image data from a document sheet, a print function for forming an image based on image data, a facsimile function, and a copy function. The image forming apparatus 10 only needs to have an image forming function, and may be a printer, a facsimile apparatus, or a copier.

As shown in FIG. 1, the image forming apparatus 10 includes an automatic document sheet conveying device 1, an image reading portion 2, an image forming portion 3, a sheet supply portion 4, a control portion 5, and an operation/display portion 6. The automatic document sheet conveying device 1 is an ADF (Auto Document Feeder). As a result, the automatic document sheet conveying device 1 is referred to as "ADF 1" in the following description. The image forming apparatus 10 of the present embodiment includes an apparatus main body 100, wherein all of the ADF 1, the image forming portion 3, the sheet supply portion 4 and the like are provided in one apparatus main body 100.

The ADF 1 conveys a document sheet so that it is read by the image reading portion 2. The ADF 1 includes a document sheet setting portion 11, a plurality of conveyance rollers 12, and a sheet discharge tray 13. The ADF 1 drives the plurality of conveyance rollers 12 in such a way as to convey a document sheet set in the document sheet setting portion 11 to the sheet discharge tray 13, while causing the document sheet to pass an image reading position where an image is read by the image reading portion 2.

The image reading portion 2 is configured to read an image from a document sheet and output image data corresponding to the read image. The image reading portion 2 includes a document sheet table 21, a light source unit 22, a plurality of mirrors 23 and 24, an optical lens 25, and a CCD (Charge Coupled Device) 26.

The image forming portion 3 realizes a print function by forming a color or monochrome image on a sheet Sh1 (see FIG. 2) by an electrophotographic method. The image forming portion 3 forms an image on the sheet Sh1 based on image data output from the image reading portion 2. In addition, the image forming portion 3 is configured to form an image on the sheet Sh1 based on image data input from an information processing apparatus, such as a personal computer, external to the image forming apparatus 10. Specifically, the image forming portion 3 includes a conveyance portion 30, a photoconductor drum 31, a charging device 32, an LSU (laser scanning unit) 33, a developing device 34, a transfer roller 35, a cleaning device 36, a fixing roller 37, a pressure roller 38, and a discharge table (sheet discharge tray) 39. The image forming portion 3 may form an image on the sheet Sh1 by an image forming method other than the electrophotographic method, such as a sublimation type thermal transfer method.

The sheet supply portion 4 supplies a sheet Sh1 to the image forming portion 3. The sheet supply portion 4 includes a plurality of sheet supply cassettes 41 and 42, a manual feed tray, a sheet conveyance path, and a plurality of conveyance rollers. The image forming portion 3 forms an image on the sheet Sh1 supplied from the sheet supply portion 4. The sheet Sh1 may be, for example, a sheet material (including a resin film) such as a sheet of paper, a sheet of coated paper, a postcard, an envelope, or an OHP (OverHead Projector) sheet.

The sheet Sh1 supplied from the sheet supply portion 4 to the image forming portion 3 is conveyed by the conveyance portion 30 to pass between the photoconductor drum 31 and the transfer roller 35 and between the fixing roller 37 and the pressure roller 38, and be discharged from a discharge port 40 to the discharge table 39. At this time, the image forming portion 3 executes, in the following procedure, an image forming process to form an image on the sheet Sh1 that has been supplied from the sheet supply portion 4 and conveyed by the conveyance portion 30.

First, the charging device 32 uniformly charges the photoconductor drum 31 to a certain potential. Next, the LSU 33 irradiates light on the surface of the photoconductor drum 31 based on image data. This allows an electrostatic latent image corresponding to the image data to be formed on the surface of the photoconductor drum 31. The developing device 34 develops (visualizes), with toner, the electrostatic latent image formed on the surface of the photoconductor drum 31, and a toner image is formed on the surface of the photoconductor drum 31. The toner container 34A attached to the image forming portion 3 in a detachable manner supplies toner to the developing device 34. Subsequently, the transfer roller 35 transfers the toner image formed on the photoconductor drum 31, to the sheet Sh1. Thereafter, the toner image transferred to the sheet Sh1 is heated by the fixing roller 37 while the sheet Sh1 passes between the fixing roller 37 and the pressure roller 38, thereby the toner image is fused and fixed to the sheet Sh1. After the image forming process by the image forming portion 3, the toner that has remained on the surface of the photoconductor drum 31 is removed by the cleaning device 36.

The control portion 5 comprehensively controls the image forming apparatus 10. The control portion 5 comprises, as a main configuration, a computer system which includes one or more processors and one or more memories. In the image forming apparatus 10, the functions of the control portion 5 are realized when the one or more processors execute programs. The programs may be previously recorded in the one or more memories, may be provided via an electric communication line such as the Internet, or may be provided recorded in a non-transitory recording medium, such as a memory card or an optical disc, that can be read by the computer system. The one or more processors are composed of one or more electronic circuits including semiconductor integrated circuits. Furthermore, the computer system mentioned here includes a microcontroller that includes one or more processors and one or more memories. The control portion 5 may be a control portion provided independently of a main control portion that comprehensively controls the image forming apparatus 10. The control portion 5 includes one or more nonvolatile memories, and previously stores information such as control programs for causing the one or more processors to execute various types of processes. Furthermore, the one or more memories are used as a temporary storage memory (a working area) for the various processes executed by the one or more processors.

The operation/display portion 6 is a user interface of the image forming apparatus 10. The operation/display portion 6 includes a display portion and an operation portion. The display portion is, for example, a liquid crystal display and displays various types of information in response to control instructions from the control portion 5. The operation portion is composed of, for example, switches or a touch panel through which various types of information are input to the control portion 5 in response to user operations. In the image forming apparatus 10, the operation/display portion 6 is disposed at a position and in an orientation that facilitate viewing and operation of the user. Specifically, the operation/display portion 6 is disposed at a front portion of the image forming apparatus 10 (apparatus main body 100), namely, on a front surface of the image forming apparatus 10 in the front-back direction D2.

In the present embodiment, the image forming apparatus 10 is what is called an in-body sheet discharge type in which the sheet Sh1 to which the toner image has been fixed, namely, the sheet Sh1 after the image formation, is discharged to a target space 700 that is provided at a center of the apparatus main body 100 in the up-down direction. As shown in FIG. 1, for example, the target space 700 is a space above the discharge table 39. Accordingly, the discharge port 40 and the discharge table 39 are disposed at a central portion of the apparatus main body 100 in the up-down direction. Furthermore, in the present embodiment, the discharge port 40 is disposed on the right side of the discharge table 39. As a result, the sheet Sh1 is discharged into the target space 700 on the discharge table 39 from the discharge port 40 that is located on the right side thereof.

The target space 700 is a space that is opened at least in one direction in a plan view. That is, in a plan view, at least one side of the rectangular target space 700 is opened. In the present embodiment, as one example, the target space 700 is opened in two directions, namely, leftward and frontward in a horizontal plane, and two adjacent sides are opened.

Meanwhile, basically, the sheet Sh1 that has been subjected to the image forming process of the image forming portion 3, namely, the sheet Sh1 with an image formed thereon, is discharged into the target space 700 on the discharge table 39 from the discharge port 40 immediately after the fixing process. Accordingly, the sheet Sh1 immediately after discharged to the target space 700 on the discharge table 39 is apt to have a higher temperature than before the image formation. Furthermore, in a case where the image forming apparatus 10 successively forms images on a plurality of sheets Sh1, the plurality of sheets Sh1 are stacked on the discharge table 39. With regard to the plurality of sheets Sh1 stacked thereon, the heat hardly escapes therefrom, and in some cases, a "blocking" may occur where two or more stacked sheets Sh1 stick to each other.

There is known, as a related technology, an image forming apparatus that includes a blowing device that is a cooling means for cooling a sheet with an image formed thereon discharged on a discharge table. In the image forming apparatus according to the related technology, the blowing device is disposed in the vicinity of an outlet from which the sheet is discharged, and below the sheet discharged from the outlet such that the blowing device blows cool wind toward a lower surface of the sheet on which the image has been formed. The blowing device takes in an external air and cool the lower surface of the sheet by blowing the external air to the lower surface of the sheet.

However, the related technology has not taken into account the destination of the airflow (external air) blown to the sheet. As a result, the airflow may cause some troubles. For example, if the airflow heated by the sheet turns to the user, it may give discomfort to the user. In addition, the airflow blown to the sheet may float the sheet and change the direction of the sheet.

On the other hand, the image forming apparatus 10 according to the present embodiment prevents the airflow from causing a problem, with the configuration described below.

Figure 2:
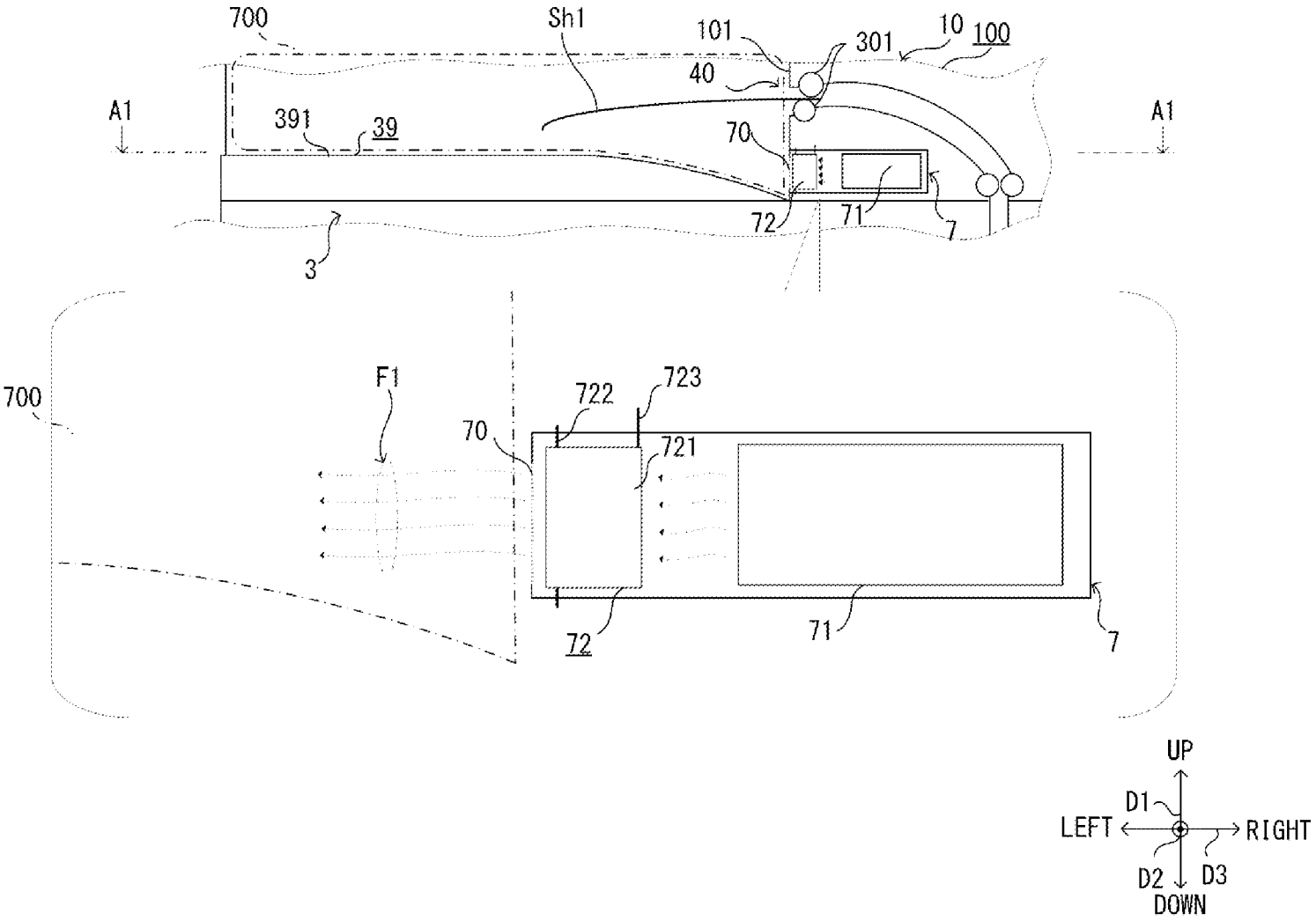
FIG. 2 is a schematic diagram showing a configuration of a major part of the image forming apparatus and an image formation air blowing device according to Embodiment 1.

That is, as shown in FIG. 1 and FIG. 2, the image forming apparatus 10 according to the present embodiment includes an image formation air blowing device 7 and an apparatus main body 100. The image formation air blowing device 7 is mounted in the apparatus main body 100 in which the image forming portion 3 is provided. Hereinafter, the image formation air blowing device 7 is referred to as a "blowing device 7". FIG. 2 shows a schematic configuration of a major part of the apparatus main body 100 including the blowing device 7 and the target space 700, wherein an enlarged view of the blowing device 7 is provided in the balloon.

The blowing device 7 includes an outlet 70 and an airflow control portion 72. The outlet 70 blows out an airflow F1 (see FIG. 2) toward the target space 700 on the discharge table 39 to which the sheet Sh1 with an image formed thereon is discharged from the image forming portion 3. The airflow control portion 72 controls the direction of the airflow F1 at least in a horizontal plane in the target space 700. Here, the "horizontal plane" mentioned here is a plane perpendicular to the up-down direction D1 that is the vertical direction, and a plane extending along the front-back direction D2 and the left-right direction D3.

With the above-described configuration, the blowing device 7 causes the airflow control portion 72 to control the direction of the airflow F1 blown out from the outlet 70 toward the target space 700 on the discharge table 39, at least in a horizontal plane in the target space 700. Accordingly, the blowing device 7 is configured to control the direction of the airflow F1 blown to the sheet Sh1 while blowing out the airflow F1 to the sheet Sh1 discharged onto the discharge table 39. As a result, a trouble that the airflow F1 heated by the sheet Sh1 turns to the user to give discomfort to the user, or a trouble that the airflow F1 blown to the sheet Sh1 floats the sheet Sh1 and changes the direction of the sheet Sh1, hardly occurs.

[2] Configuration of Image Formation Air Blowing Device

Next, a detailed description is given of the configuration of the blowing device 7 with reference to FIG. 2 to FIG. 6.

As shown in FIG. 2, the blowing device 7 includes the outlet 70, an airflow generating portion 71, and the airflow control portion 72. That is, in the present embodiment, the blowing device 7 further includes the airflow generating portion 71 in addition to the outlet 70 and the airflow control portion 72.

As shown in FIG. 2, the outlet 70 is provided in the apparatus main body 100 at a position facing the target space 700. A side wall 101 is provided in the apparatus main body 100 at a position facing the target space 700, and the outlet 70 is formed in the side wall 101. That is, the outlet 70 is a hole formed in the side wall 101 that is a part of the housing of the apparatus main body 100, and the inside and the outside of the housing are communicated with each other through the outlet 70. In the present embodiment, as one example, the outlet 70 is a rectangular opening that is elongated in the front-back direction D2. However, the shape of the outlet 70 is not limited to rectangular, but may be, for example, square, circular, triangular, pentagonal or further polygonal, or slit-like.

In addition, the outlet 70 is disposed on the discharge port 40 side when viewed from the target space 700. In the present embodiment, the discharge port 40 from which the sheet Sh1 is discharged to the target space 700 is located on the right side of the target space 700, and the outlet 70 is, like the discharge port 40, located on the right side of the target space 700. Specifically, the outlet 70 is formed in the same side wall 101 as the discharge port 40. In other words, the outlet 70 and the discharge port 40 are formed in one side wall 101 that is located on the right side of the target space 700. With this configuration, it is easy to adjust the direction of the airflow F1 from the outlet 70 to be along a direction in which the sheet Sh1 is discharged from the discharge port 40 (in the present embodiment, leftward), and it is possible to restrict the airflow F1 from interfering the direction of the sheet Sh1.

In addition, in the present embodiment, the blowing device 7 causes the airflow F1 to abut on a surface of the sheet Sh1 on a side on which an image (toner image) has been formed, when the sheet Sh1 is discharged from the discharge port 40 onto the discharge table 39. In the example shown in FIG. 2, the sheet Sh1 is discharged from the discharge port 40 in a state where the surface on the side on which the image has been formed faces downward, namely, in a state (attitude) where the surface on the side on which the image has been formed faces an upper surface 391 (a surface on which the sheets Sh1 are placed) of the discharge table 39. Accordingly, the blowing device 7 causes the airflow F1 to abut on, from below, the sheet Sh1 discharged from the discharge port 40. Specifically, as shown in FIG. 2, the outlet 70 is disposed below the discharge port 40, namely, between the discharge port 40 and the upper surface 391 of the discharge table 39 in the up-down direction D1. With this configuration, the airflow F1 from the outlet 70 abuts on the surface (in this example, a lower surface) of the sheet Sh1 on the side on which the image has been formed, when the sheet Sh1 is discharged from the discharge port 40. This allows the airflow F1 to effectively cool the surface of the sheet Sh1 on the side on which the image has been formed.

The airflow generating portion 71 has a function to generate the airflow F1. The airflow generating portion 71 is a fan unit including a motor. The airflow generating portion 71 is built in the apparatus main body 100, and the airflow F1 generated by the airflow generating portion 71 is blown through the outlet 70 toward the target space 700 external to the apparatus main body 100. The airflow generating portion 71 rotates a rotor having a blade so that the airflow F1 is generated by the rotation of the blade. The airflow generating portion 71 rotates the rotor in accordance with a drive signal from the control portion 5. In other words, the control portion 5 can control the airflow generating portion 71 and switch at least between a state of rotating the rotor to generate the airflow F1, and a state of stopping the rotor to stop generating the airflow F1. In the present embodiment, the motor of the airflow generating portion 71 is, for example, a DC (direct current) motor that operates upon application of a DC voltage.

In addition, in the present embodiment, the airflow generating portion 71 includes a sirocco fan that is a type of centrifugal fan and has a plurality of blades arranged in a drum-like shape. That is, the airflow generating portion 71 generates the airflow F1 from an outlet of a duct by taking in the air (external air) by rotating the drum-like blades and discharging the air through the duct. It is noted that the airflow generating portion 71 only needs to generate the airflow F1, and the airflow generating portion 71 is not limited to a sirocco fan, but may be, for example, a turbo-type centrifugal fan, an axial fan, a mixed flow fan, or a crossflow fan.

The airflow control portion 72 is disposed between the airflow generating portion 71 and the outlet 70. The outlet 70, the airflow generating portion 71, and the airflow control portion 72 are aligned in the left-right direction D3, the outlet 70 located closest to the target space 700 (leftmost), the airflow control portion 72 located on the right side of the outlet 70, and the airflow generating portion 71 located on the right side of the airflow control portion 72. With this configuration, the airflow F1 generated by the airflow generating portion 71 is passed through the airflow control portion 72, and is blown out from the outlet 70 into the target space 700. When the airflow F1 passes through the airflow control portion 72, the airflow control portion 72 controls the direction of the airflow F1 at least in a horizontal plane. In particular, in the present embodiment, the airflow control portion 72 can change the direction of the airflow F1 at least in a horizontal plane to a direction other than a discharge direction of the sheet Sh1 (in the present embodiment, the discharge direction is leftward) discharged from the discharge port 40. That is, the airflow control portion 72 is configured to tilt the direction of the airflow F1 in the horizontal plane with respect to the discharge direction of the sheet Sh1 from the discharge port 40 (the left-right direction D3).

Figure 3:
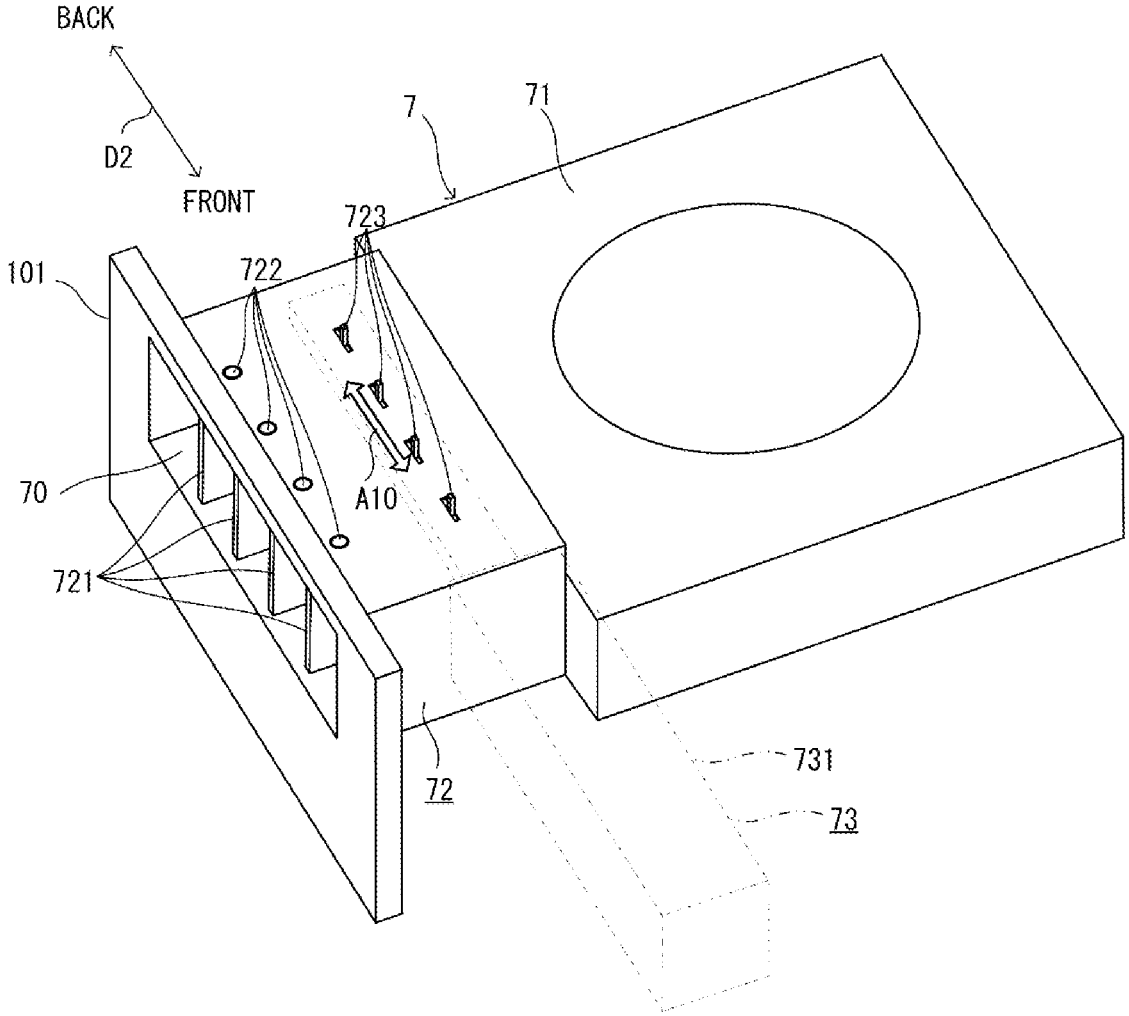
FIG. 3 is a schematic perspective diagram showing a configuration of the image formation air blowing device according to Embodiment 1.

More specifically, as shown in FIG. 3, the airflow control portion 72 includes at least one louver 721. The louvers 721 are plate-like and disposed in a flow path that includes the outlet 70. That is, at least one louver 721 is disposed in the flow path including the outlet 70 through which the airflow F1 passes. In the present embodiment, the airflow control portion 72 includes a plurality of (specifically, four) louvers 721. The four louvers 721 are aligned at equal intervals along the front-back direction D2. With such louvers 721 disposed in the flow path, it is possible to control the direction of the airflow F1 by the direction (attitude) of the louvers 721 when the airflow F1 passing through the flow path passes by the louvers 721. That is, the airflow F1 blown out from the outlet 70 is controlled by the rectification function of the louvers 721 to flow in a direction along the louvers 721. It is noted that the number of the louvers 721 is not limited to 4 (four), but may be any one of 1 (one) to 3 (three), or 5 (five) or higher.

Furthermore, in the present embodiment, the louvers 721 are movable louvers that are formed in such a way as to change their direction (attitude). Specifically, as shown in FIG. 2 and FIG. 3, each of the plurality of louvers 721 includes a rotation shaft 722 and an operation piece 723. The rotation shaft 722 projects from opposite end surfaces of the louver 721 in the up-down direction D1, and the operation piece 723 projects from an upper end surface of the louver 721. Each of the louvers 721 is supported in such a way as to rotate around the rotation shaft 722. The operation piece 723 is configured to reciprocally move within a predetermined range along the front-back direction D2. This allows each of the louvers 721 to rotate around the rotation shaft 722 within a predetermined range when the operation piece 723 reciprocally moves within the predetermined range as indicated by the arrow A10 in FIG. 3.

Figure 4:
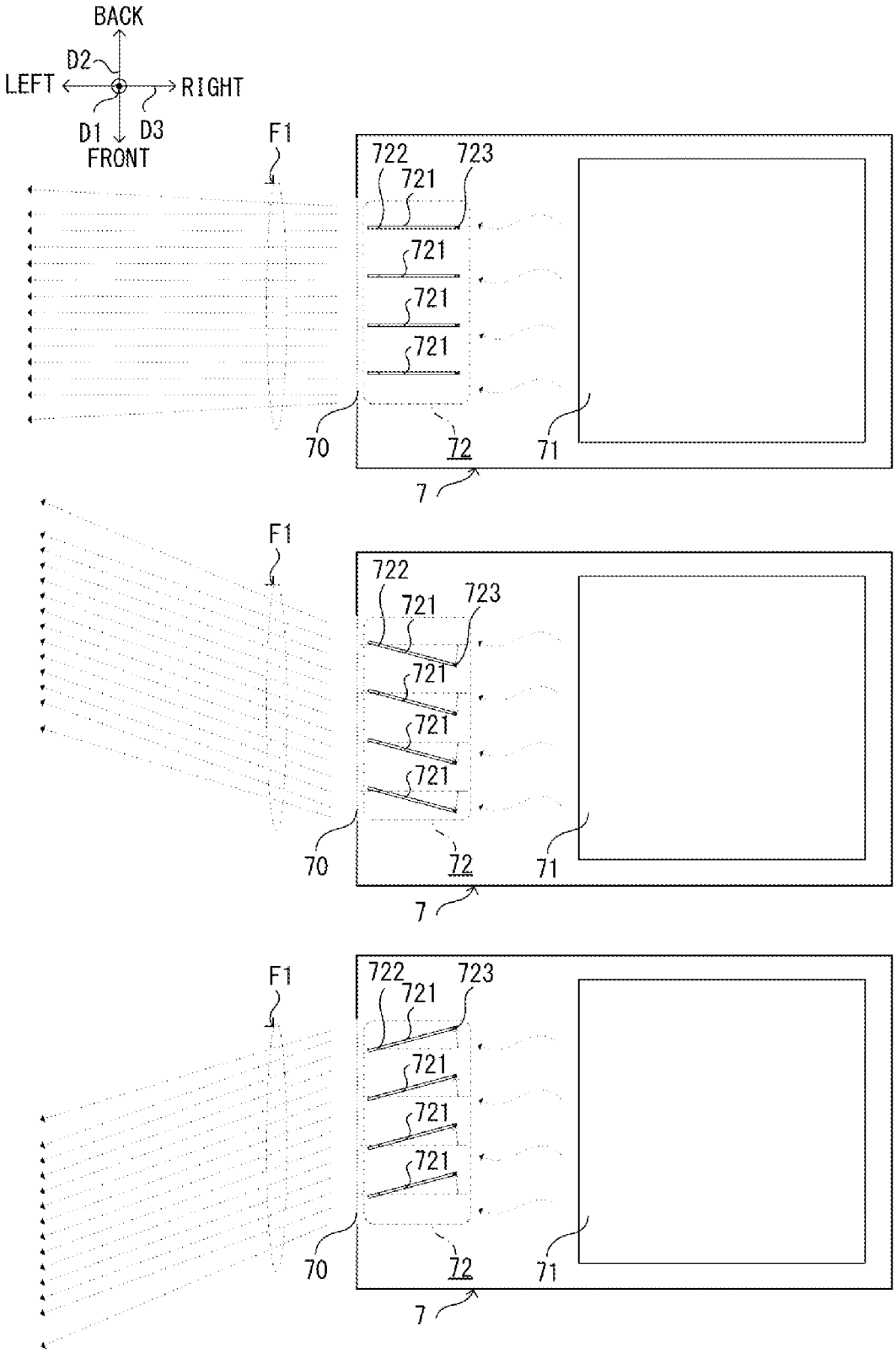
FIG. 4 is a schematic diagram in a plan view of the image formation air blowing device according to Embodiment 1.

As shown in FIG. 4, the movable louvers 721 of the above-described configuration can change the direction of the airflow F1 blown out from the outlet 70 into the target space 700. FIG. 4 is a schematic diagram of the blowing device 7 in a plan view in cases where the operation pieces 723 are moved. In FIG. 4, the upper part shows a state where each of the operation pieces 723 is located at the center of the predetermined range, the middle part shows a state where each of the operation pieces 723 is located at a front end of the predetermined range, and the lower part shows a state where each of the operation pieces 723 is located at a back end of the predetermined range. That is, when the operation pieces 723 are located at the center of the predetermined range, the airflow F1 within the horizontal plane is directed leftward approximately straight from the outlet 70 along the louvers 721. On the other hand, when the operation pieces 723 are located at the front end of the predetermined range, the airflow F1 within the horizontal plane is directed diagonally backward left from the outlet 70 along the louvers 721. In addition, when the operation pieces 723 are located at the back end of the predetermined range, the airflow F1 within the horizontal plane is directed diagonally frontward left from the outlet 70 along the louvers 721. In this way, the direction of the airflow F1 within the horizontal plane blown out from the outlet 70 into the target space 700 changes according to the direction of the louvers 721.

In addition, as shown in FIG. 3, the blowing device 7 according to the present embodiment further includes an adjustment portion 73. In FIG. 3, the adjustment portion 73 is indicated by an imaginary line (two-dot chain line). The adjustment portion 73 is configured to adjust the direction of the airflow F1 controlled by the airflow control portion 72. Here, the adjustment portion 73 changes the direction of the airflow F1 by changing the direction (attitude) of the louvers 721 in the airflow control portion 72. Specifically, the adjustment portion 73 changes the direction of the louvers 721 by displacing the operation pieces 723 of the louvers 721 within the predetermined range along the front-back direction D2. This makes it possible to adjust the direction of the airflow F1 according to circumstances. Furthermore, in the present embodiment, the adjustment portion 73 operates the operation pieces 723 of the plurality of (in this example, four) louvers 721 all together. That is, the adjustment portion 73 is coupled with the plurality of louvers 721 and causes the plurality of louvers 721 to reciprocally move as a unit along the front-back direction D2. As a result, the plurality of (in this example, four) louvers 721 are adjusted to the same direction by the adjustment portion 73.

Furthermore, in the present embodiment, the adjustment portion 73 includes an actuator 731 configured to adjust the direction of the airflow F1. The "actuator" mentioned here is a device configured to convert an energy such as electricity, air pressure, or oil pressure into a mechanical movement, and includes, for example, a motor (electric motor), an electromagnetic solenoid, a hydraulic cylinder, a pneumatic cylinder, and a device using a shape memory alloy. The actuator 731 adjusts the direction of the airflow F1 by moving the operation pieces 723 of the louvers 721 along the front-back direction D2. The adjustment portion 73 drives the actuator 731 according to a control signal from the control portion 5. In other words, the control portion 5 can control the adjustment portion 73 and instruct it how to adjust the direction of the airflow F1. In the present embodiment, as one example, an electromagnetic solenoid is used as the actuator 731. This makes it possible to automatically adjust the direction of the airflow F1 without manual adjustment.

Figure 5:
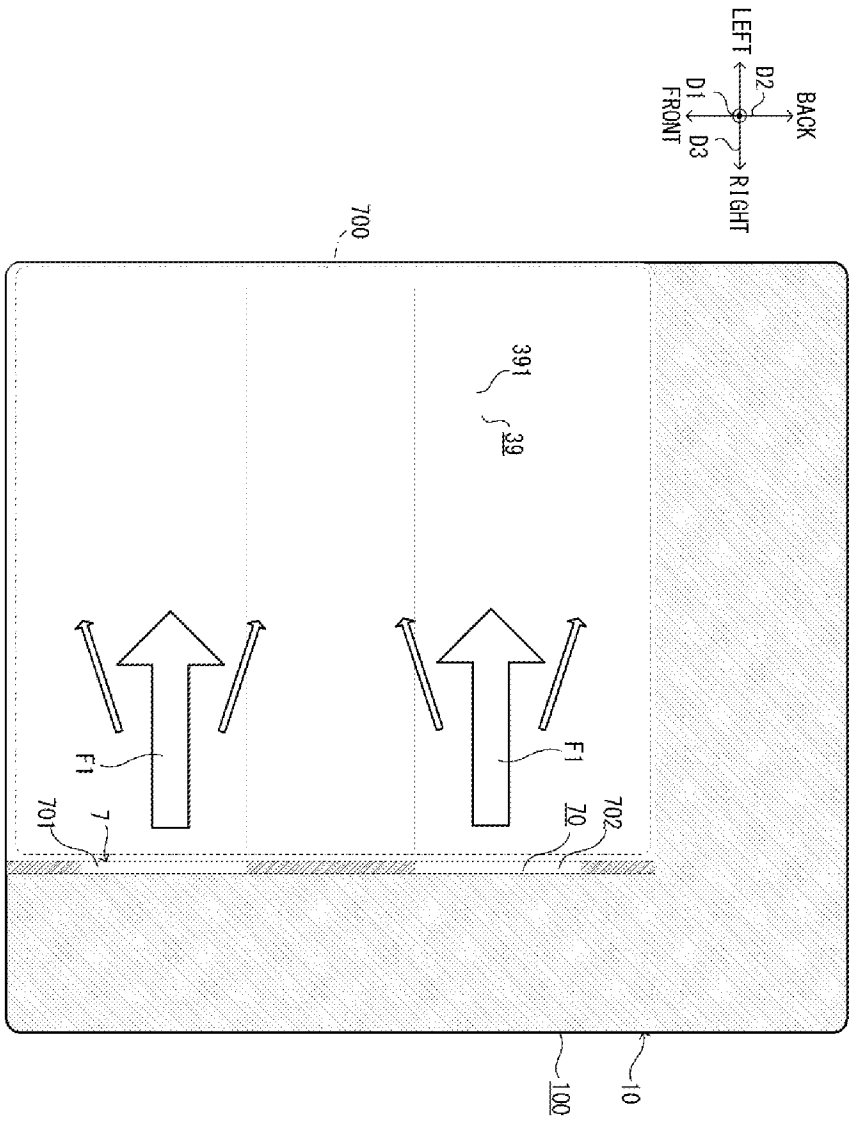
FIG. 5 is a cross-sectional diagram taken along the A1-A1 line of FIG. 2 and viewed from a direction indicated by the arrows, showing an operation of the image formation air blowing device according to Embodiment 1.

In addition, in the present embodiment, as shown in FIG. 5, the outlet 70 includes a plurality of divided outlets 701 and 702. The plurality of (in this example, two) divided outlets 701 and 702 are arranged with an interval therebetween in the front-back direction D2, the divided outlet 701 being on the front side of the divided outlet 702. The plurality of divided outlets 701 and 702 function as the outlet 70. That is, the blowing device 7 blows out the airflow F1 from each of the plurality of divided outlets 701 and 702 toward the target space 700. It is noted that the above-described airflow generating portion 71 and airflow control portion 72 are provided at each of the two divided outlets 701 and 702. With this configuration, the blowing device 7 blows out the airflow F1 to a relatively wide range in the target space 700. In the example shown in FIG. 5, the airflow control portion 72 controls such that both the airflow F1 from the divided outlet 701 on the front side and the airflow F1 from the divided outlet 702 on the back side are directed leftward approximately straight.

In the present embodiment, the two divided outlets 701 and 702 are arranged substantially symmetrically to the center of the discharge table 39 in the front-back direction D2. This allows the blowing device 7 to blow out the airflows F1 that are symmetric in the front-back direction D2, from the two divided outlets 701 and 702. However, the number of the divided outlets is not limited to 2 (two), but may be 3 (three) or higher. Furthermore, the plurality of divided outlets 701 and 702 may not be arranged symmetrically, and the plurality of divided outlets 701 and 702 may be aligned along the up-down direction D1.

Furthermore, in the present embodiment, the airflow control portion 72 controls the direction of the airflow F1 with respect to each of the plurality of divided outlets 701 and 702 individually. That is, since the airflow control portion 72 is provided at each of the two divided outlets 701 and 702, the airflow control portions 72 can control the direction of the airflow F1 for each of the divided outlets 701 and 702, independent of each other.

As one example, the airflow control portion 72 controls the direction of the airflow F1 with respect to each of the divided outlets 701 and 702 such that the airflow F1 from the divided outlet 701 on the front side is directed leftward approximately straight, and the airflow F1 from the divided outlet 702 on the back side is directed diagonally frontward left. As another example, the airflow control portion 72 controls the direction of the airflow F1 with respect to each of the divided outlets 701 and 702 such that the airflow F1 from the divided outlet 701 on the front side is directed diagonally backward left, and the airflow F1 from the divided outlet 702 on the back side is directed leftward approximately straight. As yet another example, the airflow control portion 72 controls the direction of the airflow F1 with respect to each of the divided outlets 701 and 702 such that the airflow F1 from the divided outlet 701 on the front side is directed diagonally frontward left, and the airflow F1 from the divided outlet 702 on the back side is directed diagonally backward left. This configuration provides a higher degree of freedom to the adjustment of the direction of airflow F1 in the target space 700, compared with a case where the outlet 70 has a single hole (opening).

Figure 6:
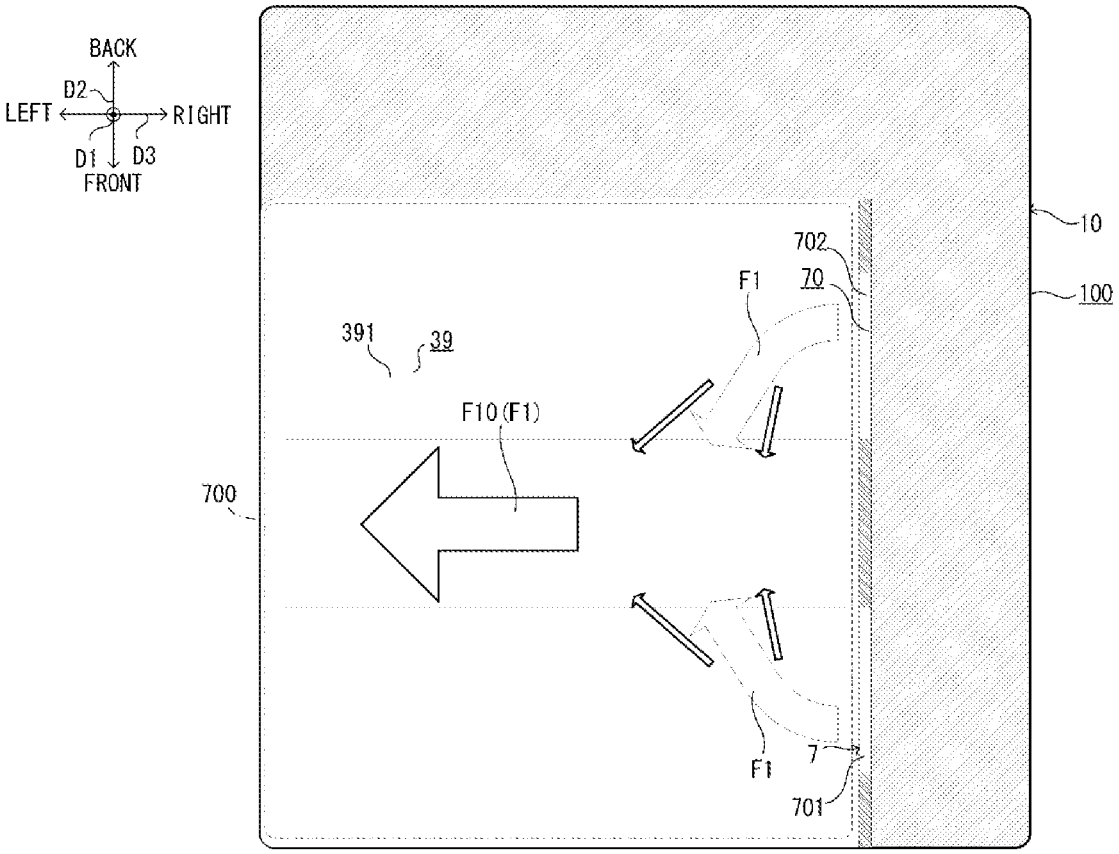
FIG. 6 is a cross-sectional diagram taken along the A1-A1 line of FIG. 2 and viewed from a direction indicated by the arrows, showing another operation of the image formation air blowing device according to Embodiment 1.

In addition, in the present embodiment, the adjustment portion 73 is also provided at each of the two divided outlets 701 and 702. This allows the adjustment portions 73 to adjust the direction of the airflow F1 for each of the divided outlets 701 and 702. In particular, in the present embodiment, the adjustment portion 73 is configured to switch between a plurality of modes including a "first mode" in which the directions of the airflow F1 shown in FIG. 5 are adopted, and a "second mode" in which the directions of the airflow F1 shown in FIG. 6 are adopted. That is, at least as shown in FIG. 6, the adjustment portion 73 can control the direction of the airflow F1 with respect to each of the divided outlets 701 and 702 such that the airflow F1 from the divided outlet 701 on the front side is directed diagonally backward left, and the airflow F1 from the divided outlet 702 on the back side is directed diagonally frontward left.

As shown in FIG. 6, in the second mode, the airflow F1 from the divided outlet 701, one of the plurality of divided outlets 701 and 702, and the airflow F1 from the divided outlet 702, another one of the plurality of divided outlets 701 and 702, merge in the target space 700. That is, in the state shown in FIG. 6, the airflows F1 from the two divided outlets 701 and 702 are both directed inward (toward the center) of the target space 700 in the front-back direction D2. Accordingly, the airflows F1 output from the two divided outlets 701 and 702 merge at near the center of the target space 700 in the front-back direction D2 to form one airflow F10 directed leftward. This allows the airflows F1 output from the divided outlets 701 and 702 to be treated as one airflow F10 finally. This makes it possible to generate an appropriate airflow F1 according to circumstances.

Furthermore, as shown in FIG. 6, in the second mode, the airflow control portion 72 controls the direction of the airflow F1 such that, in the horizontal plane, the airflow F1 is close to symmetric in a direction (the front-back direction D2) perpendicular to the direction in which the sheet is discharged from the discharge port 40. Here, the "close to symmetric" mentioned here means that the airflow F1 is more symmetric, compared with a case where the airflow control portion 72 is not provided, and includes a form where the airflow F1 is not completely symmetric.

That is, in the present embodiment, since the outlet 70 is disposed on the discharge port 40 side when viewed from the target space 700, the direction of the airflow F1 from the outlet 70 is basically along the direction in which the sheet Sh1 is discharged from the discharge port 40 (in the present embodiment, leftward). Here, if the direction of the airflow F1 from the outlet 70 is asymmetric with respect to the direction (the front-back direction D2) perpendicular to the direction in which the sheet Sh1 is discharged from the discharge port 40, a force of the airflow F1 in the direction perpendicular to the direction in which the sheet Sh1 is discharged from the discharge port 40, acts on the sheet Sh1 discharged from the discharge port 40. In this case, a variation in position in the front-back direction D2 is apt to occur in the sheets Sh1 discharged onto the discharge table 39. On the other hand, with respect to the airflow F1 that is substantially symmetric as shown in FIG. 6, a force in the direction perpendicular to the discharge direction of the sheet Sh1 hardly acts on the sheet Sh1, and a variation in position of the sheet Sh1 in the front-back direction D2 hardly occurs.

Furthermore, as shown in FIG. 6, in the second mode, the airflow control portion 72 controls the direction of the airflow F1 in such a way as to reduce the flow amount of the airflow F1 that flows toward the front of the image forming apparatus 10 facing the user of the image forming apparatus 10. Here, "reduce the flow amount of the airflow F1 that flows toward the front" means that the flow amount of the airflow F1 flowing toward the front is reduced, compared with a case where the airflow control portion 72 is not provided, and includes a form where the flow amount of the airflow F1 that flows toward the front is 0 (zero), namely, no airflow F1 flows toward the front. That is, in the example shown in FIG. 6, since the airflow F1 from the divided outlet 701 on the front side is directed diagonally backward left, the flow amount of the airflow that flows toward the front of the image forming apparatus 10 is reduced with respect to the airflow F1 from the divided outlet 701 on the front side. Furthermore, in the example shown in FIG. 6, although the airflow F1 from the divided outlet 702 on the back side is directed diagonally frontward left, the airflow F1 merges with the airflow F1 from the divided outlet 701 on the front side, and with respect to the airflow F1 from the divided outlet 702 on the back side, the flow amount of the airflow that flows toward the front of the image forming apparatus 10 is reduced.

In short, in the image forming apparatus 10 in which the blowing device 7 is provided, the operation/display portion 6 is disposed on a front part of the image forming apparatus 10 (apparatus main body 100), namely, on the front surface (front side) of the image forming apparatus 10 in the front-back direction D2. Generally, the user who uses the image forming apparatus 10 as such, namely, operates the operation/display portion 6, stands in front of the image forming apparatus 10. As a result, the airflow F1 that flows toward the front of the image forming apparatus 10 may flow toward the user standing in front of the image forming apparatus 10, and the airflow F1 heated by the sheet Sh1 may turn to the user to give discomfort to the user. On the other hand, with the configuration where the flow amount of the airflow F1 that flows toward the front of the image forming apparatus 10 is reduced, it is possible to restrict the airflow F1 heated by the sheet Sh1 from turning to the user to give discomfort to the user.

Furthermore, as in the present embodiment, when the configuration is adopted where the adjustment portion 73 includes the actuator 731 and the direction of the airflow F1 is automatically adjusted, the following function can be realized.

For example, it may be determined whether a user is present in front of the image forming apparatus 10 by means of monitoring operation on the operation/display portion 6 or a human sensor, and only when the user is present in front of the image forming apparatus 10, the direction of the airflow F1 may be adjusted so that the airflow F1 does not turn to the user. That is, when no user is present in front of the image forming apparatus 10, the direction of the airflow F1 shown in FIG. 5 (the first mode) is adopted so that the airflow F1 is effectively blown to the sheet Sh1 to restrict an occurrence of the blocking. On the other hand, when a user is present in front of the image forming apparatus 10, the direction of the airflow F1 shown in FIG. 6 (the second mode) is adopted so as to restrict the airflow F1 heated by the sheet Sh1 from turning to the user to give discomfort to the user. As a result, it is possible to automatically provide appropriate airflow F1 according to circumstances.

[3] Modification Examples

A plurality of components of the image forming apparatus 10 may be provided in a plurality of housings in a dispersed manner. For example, the blowing device 7 may be provided in a housing different from a housing that stores the image forming portion 3 and the like. That is, the blowing device 7 may not be provided integrally with the image forming apparatus 10, but may be provided in a housing different from that of the image forming apparatus 10.

In addition, the louver 721 that is a movable louver configured to change its direction (attitude) is not a requisite configuration for the blowing device 7. That is, the direction (attitude) of the louver 721 may be fixed. In this case, the adjustment portion 73 can be omitted.

In addition, the airflow control portion 72 including the louver 721 is not a requisite configuration for the blowing device 7. That is, the airflow control portion 72 may control the direction of the airflow F1 by using another means other than the louver 721. For example, it is possible to control the direction of the airflow F1 by changing the flow speed of the blown airflow F1 between the plurality of divided outlets 701 and 702. That is, in a case where there is a pressure difference in the target space 700, the airflow F1 turns from a region with high pressure to a region with low pressure. Accordingly, it is possible to control the direction of the entire airflow F1 blown out from the divided outlets 701 and 702 by setting a difference between the flow speeds of the airflows F1 blown out from the divided outlets 701 and 702. That is, if a difference is set between the flow speed of the airflow F1 blown out from the divided outlet 701 and the flow speed of the airflow F1 blown out from the divided outlet 702, a pressure difference occurs between a region on the divided outlet 701 side and a region on the divided outlet 702 side. This makes it possible to control the direction of the entire airflow F1 blown out from the divided outlets 701 and 702. In this way, the airflow control portion 72 may control the direction of the airflow F1 indirectly by using the difference between the flow speeds of the airflows F1, namely, the pressure difference.

Embodiment 2

Figure 7:
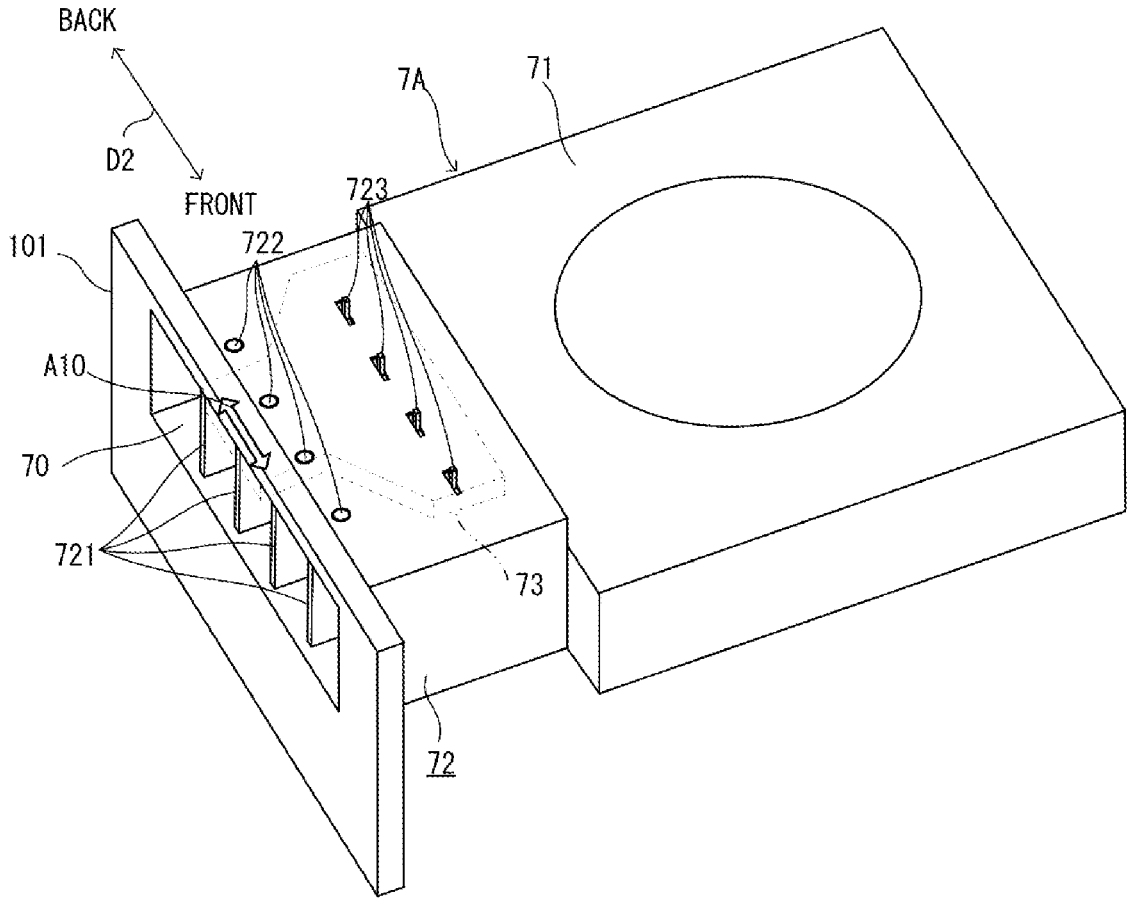
FIG. 7 is a schematic perspective diagram showing a configuration of an image formation air blowing device according to Embodiment 2.

As shown in FIG. 7, a blowing device 7A according to Embodiment 2 differs in configuration of the adjustment portion 73 from the blowing device 7 according to Embodiment 1. In the following description, the same components as those in Embodiment 1 are assigned the same reference signs, and description thereof is omitted as necessary. In FIG. 7, the adjustment portion 73 is indicated by an imaginary line (two-dot chain line).

In the present embodiment, the adjustment portion 73 is a lever structure for a human manual adjustment. That is, a person operates a part of the adjustment portion 73 to move the adjustment portion 73 as indicated by the arrow A10 in FIG. 7. At this time, the adjustment portion 73 changes the direction of the louvers 721 by causing the operation pieces 723 of the louvers 721 to move within a predetermined range along the front-back direction D2. The configuration of the present embodiment makes it possible to simplify the blowing device 7A.

Embodiment 3

Figure 8:
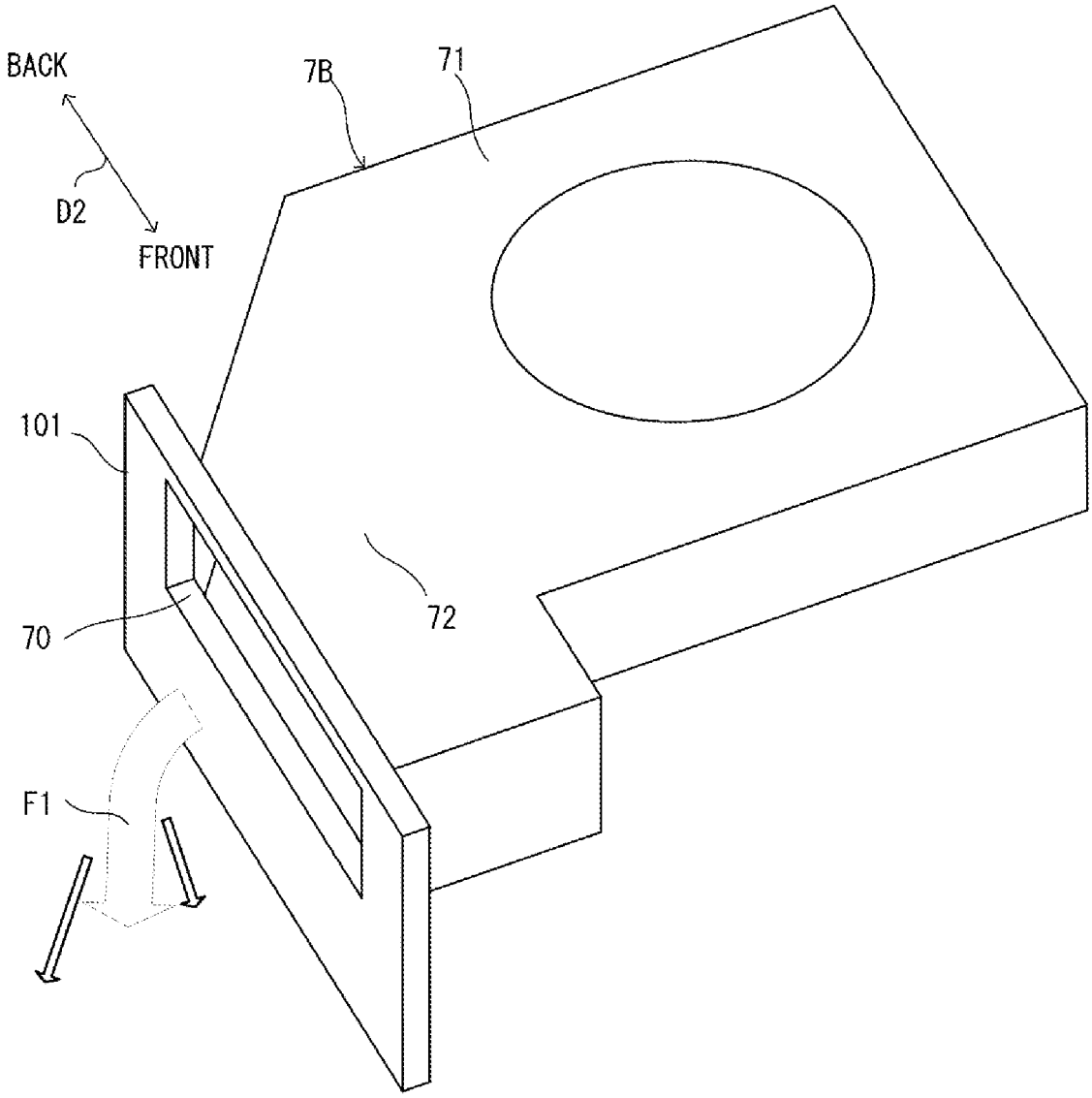
FIG. 8 is a schematic perspective diagram showing a configuration of an image formation air blowing device according to Embodiment 3.

As shown in FIG. 8, a blowing device 7C according to Embodiment 3 differs in configuration of the airflow control portion 72 from the blowing device 7 according to Embodiment 1. In the following description, the same components as those in Embodiment 1 are assigned the same reference signs, and description thereof is omitted as necessary.

In the present embodiment, the airflow control portion 72 is realized by a duct that continues to the airflow generating portion 71. That is, in a case where the airflow generating portion 71 is a sirocco fan, it is possible to control the direction of the airflow F1 by the extension direction of the duct of the sirocco fan. In the example shown in FIG. 8, the duct as the airflow control portion 72 is extended diagonally frontward left from the airflow generating portion 71. Accordingly, the airflow F1 from the outlet 70 is directed diagonally frontward left.

In the present embodiment, the adjustment portion 73 is omitted. However, the adjustment portion 73 may be provided additionally.

In addition, in the airflow control portion 72, the louvers 721 described in Embodiment 1 may be used in addition to the duct of the sirocco fan of the present embodiment. That is, a configuration for controlling the airflow F1 by the duct of the sirocco fan may be combined with a configuration for controlling the airflow F1 by the louvers 721.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image formation air blowing device comprising:

an outlet configured to blow out an airflow toward a target space on a discharge table to which a sheet with an image formed thereon by an image forming portion is discharged; and an airflow control portion configured to control a direction of the airflow at least in a horizontal plane in the target space, wherein the outlet includes a plurality of divided outlets, a mode of the airflow blown out from the outlet is switched among a plurality of modes including a first mode and a second mode, in the first mode, an airflow from a first one of the plurality of divided outlets and an airflow from a second one of the plurality of divided outlets flow in a same direction with respect to the target space so as not to merge in the target space, and in the second mode, the airflow from the first one of the plurality of divided outlets and the airflow from the second one of the plurality of divided outlets merge in the target space.

2. The image formation air blowing device according to claim 1, wherein the airflow control portion includes a louver that is disposed in a flow path that includes the outlet.

3. The image formation air blowing device according to claim 1, wherein the airflow control portion controls the direction of the airflow in such a way as to reduce a flow amount of the airflow that flows toward a front of an image forming apparatus that faces a user using the image forming apparatus, the image forming apparatus including the image forming portion.

4. The image formation air blowing device according to claim 1, wherein the airflow control portion controls the direction of the airflow with respect to each of the plurality of divided outlets individually.

5. The image formation air blowing device according to claim 1, wherein when viewed from the target space, the outlet is disposed on a side of a discharge port from which the sheet is discharged to the target space, and the airflow control portion controls the direction of the airflow such that, in the horizontal plane, the airflow is close to symmetric in a direction perpendicular to a direction in which the sheet is discharged from the discharge port.

6. The image formation air blowing device according to claim 1, further comprising:

an adjustment portion configured to adjust the direction of the airflow controlled by the airflow control portion.

7. The image formation air blowing device according to claim 6, wherein the adjustment portion includes an actuator configured to adjust the direction of the airflow.

8. An image forming apparatus comprising:

the image formation air blowing device according to claim 1; and an apparatus main body which includes the image forming portion and in which the image formation air blowing device is mounted.

* * * * *